US005897947A

United States Patent [19]

Funk

[11] Patent Number: 5,897,947

[45] Date of Patent: Apr. 27, 1999

[54] METHOD OF COATING AND THREAD GUIDING ELEMENTS PRODUCED THEREBY

[75] Inventor: Wilhelm Funk, Kreuzlingen, Switzerland

[73] Assignee: Maschinenfabrik Rieter AG, Winterthur, Switzerland

[21] Appl. No.: 08/594,916

[22] Filed: Jan. 31, 1996

[30] Foreign Application Priority Data

Jan. 31, 1995 [CH] Switzerland ..... 00 253/95-5

[51] Int. Cl.[6] ..... B32B 9/00

[52] U.S. Cl. ..... 428/325; 428/328; 428/329; 428/469; 428/472; 428/699

[58] Field of Search ..... 428/325, 328, 428/329, 469, 472, 699

[56] References Cited

U.S. PATENT DOCUMENTS

| | | | |
|---|---|---|---|
| 3,080,134 | 3/1963 | England et al. | 242/157 R |
| 3,125,539 | 3/1964 | Teague | 502/63 |
| 3,147,087 | 9/1964 | Eisenlohr | 75/234 |
| 3,155,439 | 11/1964 | Guzewicz | 384/286 |
| 3,266,477 | 9/1966 | Stiles | 126/19 R |
| 3,279,939 | 10/1966 | Yenni | 219/76.14 |
| 3,677,975 | 7/1972 | Bennett et al. | 252/518 |
| 3,751,295 | 8/1973 | Blumenthal et al. | 427/453 |
| 3,902,234 | 9/1975 | Fernandes | 492/37 |
| 4,391,879 | 7/1983 | Fabian et al. | 428/551 |

FOREIGN PATENT DOCUMENTS

| | | |
|---|---|---|
| 0 054 165 | 6/1982 | European Pat. Off. . |
| 0 223 104 | 5/1987 | European Pat. Off. . |
| 0 341 229 | 11/1989 | European Pat. Off. . |
| 0 401 611 | 12/1990 | European Pat. Off. . |
| 4 423 063 | 4/1991 | European Pat. Off. . |
| 0 532 252 | 3/1993 | European Pat. Off. . |
| 0 592 310 | 4/1994 | European Pat. Off. . |
| 37 21 008 | 10/1988 | Germany . |
| 2 041 246 | 9/1980 | United Kingdom . |
| 2 130 250 | 5/1984 | United Kingdom . |
| 87/06273 | 10/1987 | WIPO . |

*Primary Examiner*—Timothy M. Speer
*Attorney, Agent, or Firm*—Dority & Manning, P.A.

[57] ABSTRACT

A catalytically active object is produced by thermal spraying of platinum powder (54) together with a coating material (52) onto the object (18) during the formation of the outer layer of the object. In a preferred embodiment, the object is a godet of a synthetic filament processing machine, the coating material is an abrasion resistant ceramic and the platinum is exposed on the thread contacting surface of the godet to promote oxidation of deposits from the filaments being processed.

7 Claims, 1 Drawing Sheet

METHOD OF COATING AND THREAD GUIDING ELEMENTS PRODUCED THEREBY

FIELD OF THE INVENTION

The invention relates to the coating of objects (for instance. machine parts) and to objects with corresponding coatings. The invention is concerned particularly, however not exclusively, with the coating of elements for guiding threads which contain synthetic fibers or filaments (for instance, drawing rolls for chemical fiber installations). Various effects can be achieved with coating methods according to this invention but the invention is particularly of interest for the manufacturing of elements which produce a catalytic effect on their exposed surfaces in order to achieve decomposition of deposits on such surfaces. Thus a self-cleaning effect can be achieved. The decomposition can take place through the effects of oxygen from the air. The invention also can be used to produce objects for causing other catalytic effects, for instance for the better burning of exhaust or to catalyze chemical processes of all types.

BACKGROUND

From U.S. Pat. No. 3,080,134 it is known to provide a machine part with a hard ceramic coating having predetermined surface qualities, with regard to the micro-structure of the surface (rounded rather than sharp-edged elevations) as well as the degree of the resulting roughness. From U.S. Pat. No. 3,902,234, it is known to provide a drawing roll used during spinning of synthetic yarns with a ceramic coating according to U.S. Pat. No. 3,080,134 and thereafter to deposit metallic platinum or metallic palladium between the elevations in the ceramic coating surface. These metals have the effect of catalysts to enhance the decomposition of deposits on the surface of the draw roll through the influence of oxygen from the air. The decomposition is achieved through a slow, little by little, "burning" of the deposits at temperatures below the melting temperature of the synthetic material.

The concept of such a catalyst coating is excellent. The realization of such a coating according to U.S. Pat. No. 3,902,234, however, shows certain drawbacks. This patent teaches that the catalytic metal should, after a chemical reaction in a solution, deposit itself in the form of particles between the elevations in the surface of the ceramic coating. The process has to be carried out in several steps, since the reactive components have to be applied on the object one at a time, after which the object must be heated, in order to accelerate the reaction. Since the deposition can not be carried out selectively, a layer of the catalyst is formed between the elevations as well as on them. Generally, only a very loose bond develops between the metal and the ceramic surface, so that the outer part of the metal coating can easily be brushed off, which leaves the desired catalytic deposits between the elevations, however with the loss of the removed catalyst material. Even if the latter material is used again, this further complicates the process. Additionally, the particles have to be very fine in order to lay between the elevations. Such fine particles can enter the lungs, which would be particularly dangerous if the particles are needle-shaped. Furthermore, platinum requires special treatment anyhow, because for platinum-bonds extremely low MAK values apply (MAK=Maximum-Arbeitsplatz-Konzentration/maximum workplace concentration).

It is known from U.S. Pat. No. 3,266,477 to provide cooking utensils with catalyst coatings in order to obtain a "self-cleaning" effect. For this one can expect relatively high operating temperatures (200 to 260° C.) and the catalyst layer is obviously designed as a non-interrupted coating of the protected surface, even though the possibility of an interruption is mentioned at column 5, line 32 of the patent. Different types of catalysts are considered, some of which can be applied by means of plasma spraying (column 2, line 30). Precious metals, even though they are mentioned as catalysts in U.S. Pat. No. 3,266,477, are apparently not used for spraying.

It is also known that it is for instance possible to spray platinum, as is mentioned in a paper ("Plasma Spraying Technique—Basics and Applications") by Plasma Technik AG, 5607 Hägglingen, Switzerland. The production of platinum catalysts by means of spraying however, is rather unusual. It is, for instance, not mentioned in the context of Römpp's Chemie Lexikon, (Encyclopaedia of Chemistry) published by Keller, Stuttgart, Germany (edition 8, 1987, page 3256). Known (in U.S. Pat. No. 3,136,658 and U.S. Pat. No. 3,125,539) is the application of platinum protective layers by means of wire-spraying, wherein platinum is furnished in the form of wires to metal spray guns which fuse, atomize and spray the platinum. In U.S. Pat. No. 3,125,539 an application of platinum in the form of powder is also mentioned (column 3, line 16). The production of protective layers using materials from the platinum family is, however, not the object of this invention.

The following possibilities are also known from the known art:

| | |
|---|---|
| EP-A-423063- | A protective layer is formed from a metallic matrix, wherein carbide and oxide ceramic-particles are embedded to serve as resistive substances. During the coating process oxide particles can be produced by way of a so called method of high-speed-flame-spraying. |
| EP-A-54165- | Printing drum with complex layer structure, with an (inner) layer of $TiO_2$ with 3% platinum applied with the method of plasma spraying. Platinum is used as an additive to obtain electric conductivity. |
| GB-2130250- | Production of a bearing alloy (e.g. from Al/Pb), by using a method of plasma spraying to build up layers and whereby the portion of one component increases steadily. |
| EP-A-223104- | Application of a protective layer consisting of aluminum silicate. For this the method of plasma spraying can be applied. |
| DE-372 1008- | In a bearing alloy similar to the alloy according to GB 2130250, parts of a resistive substance are added to the plasma stream. |
| US-3279939- | A layer having a high wear resistance at high performance temperature (e.g. above 1000° F.) can be formed by a method of spraying. |
| EP-A-592310- | A layer with a low friction coefficient can be formed by a method of thermal spraying. |
| EP-A-401611- | A layer for protecting against corrosion and wear consists of high temperature compound material, and can be formed through building-up-welding or the method of plasma spraying. Platinum is mentioned as an additive substance for improvement of the corrosion stability and for stabilizing the carbides. |
| US-3020182- | Formation of ceramic/metal bond through thermal spraying. |

The above listed examples show that the application of the method of thermal spraying has been known for a long time. Nevertheless, a catalytic effect is not mentioned.

SUMMARY OF THE INVENTION

It is an object of the present invention to provide a method, and the respective products, which allow the achievement of the advantageous effects of the products according to U.S. Pat. No. 3,902,234, along with a simplification of the production and prolongation of the product's life.

A method according to the invention comprises the treatment of an object by thermal spraying to form a layer of a treatment material on the surface of the object. The method envisions particularly that an active substance be sprayed together with the treatment material.

The treatment material can form a protective layer which is for instance resistant against wear, corrosion or similar damage. Ceramic layers are especially suitable for this purpose.

The active substance can be applied for the purpose of influencing properties of the exposed surfaces of the object to be treated, e.g. for causing catalytic decomposition of deposits thereon. This or another active substance may also be used to obtain other effects, for example:

1) To influence the properties of the treatment layer itself, for instance to increase its tenacity.
2) To influence the properties of a common surface of the object and of the treatment layer, for instance to improve the adhesion of the treatment layer.

The active substance can thus be provided within all the layers or only within predetermined layers of the treatment material. The active substance is preferably applied in a few selected layers, since the active substance itself is expensive (for instance platinum) and since its effect is only required on a certain surface (for instance on an exposed surface). The spraying method can be carried out with conventionally known spraying devices, for instance by means of a spray gun which is guided by a computer controlled robot within a protective cabinet with respect to a holding fixture for the object. The feeding to the spraying device is arranged and controlled in such a way that at least at intervals during spraying, the treatment material as well as the active substance are fed to the spraying device to be forwarded to the object. Two materials may be supplied, each separately or a mixture of the two materials. In the latter case it should be assured that a separation of the mixing components does not occur (at least not before the materials are fed from the spraying device against the object). Suitable measures for the purpose are:

formation of a so called "mechanical alloy" of those materials which are to be sprayed together.

enclosure of particles of one material with a layer of each of the other material the formation of a sintered body made up of the two materials which are then cut down into small sprayable particles.

The term "thermal spraying" includes at least plasma spraying, flame spraying, high velocity flame spraying (HVOF) and detonation spraying and also further processes that lead to acceptable results.

Spraying methods require supplies of sprayable material in the form of particles with a predetermined minimum and maximum size. Said particles can be ball-shaped before spraying. They are, however "flattened" when they impinge against the object surface, whereby they are being embedded within the layer that builds itself up, they melt together with said layer respectively. Thus a strong bond develops between each newly arriving particle and the material that is already present and forming a layer. Thus a compound material builds up which includes "islands" of the active substance within the substratum of the treatment material.

Before spraying the particles can be of a size of approximately 10 $\mu$m. Such particles do not enter the lung. The size of the particles influences the surface quality. With a spraying method, surfaces with roughness values of between RA 0, 1 $\mu$m and 10 $\mu$m can be reached. The bond within the layers is strong enough so that the product can be ground or brushed.

Furthermore the object of the invention is in particular a machine element, which is provided with a coating achieved through thermal spraying, whereby an active substance is embedded within the coating by way of combined-spraying in such a way that the active substance will appear on an exposed surface of the object. The coating can be formed in such a way that discrete islands of a predetermined active substance are distributed within the substratum of the coating and embedded within it and/or enclosed therein.

The active substance can consist of up to approximately 50% of the total weight of the coating. Normally, up to 10% (particularly between 2% and 10%) of said weight should be sufficient as active substance to achieve the desired effect. The substratum can consist of a material which is resistant against wear and which at the same time makes it possible to obtain a predetermined surface quality, for instance to achieve a predetermined roughness value, friction coefficient respectively (in contact with a predetermined counter surface).

BRIEF DESCRIPTION OF THE DRAWINGS

Embodiments of the invention will be disclosed by reference to the accompanying drawings wherein.

DETAILED DESCRIPTION OF PREFERRED EMBODIMENTS

Figure 1:
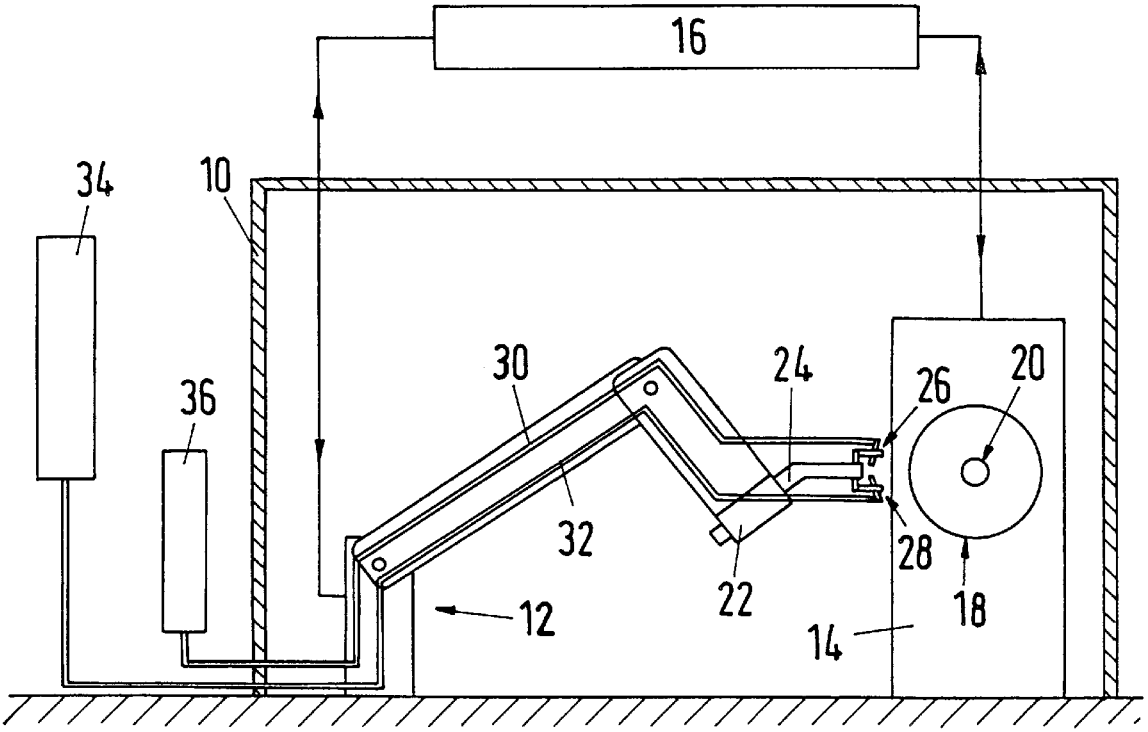
FIG. 1 shows schematically apparatus suitable for plasma-spraying according to this invention.

FIG. 1 shows schematically in a cross sectional view a protective cabinet 10, which encloses a robot 12 and a fixture 14 to hold the object. The design of the robot 12 complies with today's conventional state of the art and includes a drive system (not shown), which is controlled by a programmable control unit 16. The control unit 16 is installed in an operating unit (not shown), which is to be provided outside of the cabinet 10. The drive (not shown) of the fixture to hold the object is controlled by the same control unit 16. In the example shown the fixture 14 holds a cylindrical object 18, which, by means of the drive of the fixture 14 can be turned at a predetermined speed around axis 20. At the same time the robot 12 can be controlled in order to move a gripping device 22 back and forth parallel to the axis of the object 18 and toward and away from the surface of the object 18.

Figure 2:
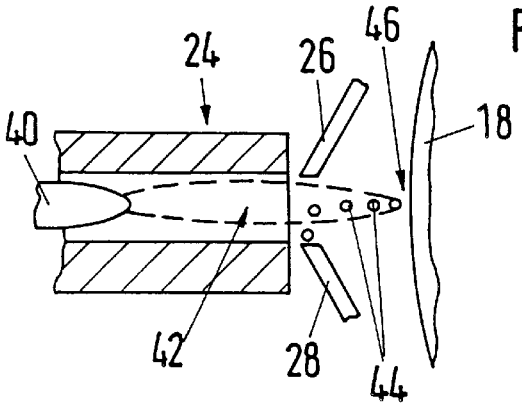
FIG. 2 shows schematically a view of the spray-gun of the apparatus of FIG. 1.

The gripping device 22 holds a spray-gun 24, having an outlet part that is further described together with FIG. 2. The gun 24 is provided with two powder injectors 26,28, each of which is connected by a flexible tube 30,32 with a respective powder reservoir 34,36. A conveying gas supply line (not shown) is connected with each reservoir 34,36, so that if the gas supply is activated, powder can be supplied from at least one reservoir 34, 36 by means of the corresponding injector 26,28. The gas supply can be activated selectively from the operating unit.

The outlet part of the pistol 24 includes a tube 38 with an open end which is positioned opposite the object 18. Within the tube 38 an electrode 40 is provided and during operation a light arc (plasma) 42 is formed which reaches up to the object 18 and which creates a transport path in the direction of the object 18. Into this arc 42 the powdered particles 44 ejected from the injector 28 (and/or 26) are introduced and immediately taken along in the direction of the object 18 and impinge against the surface part 46 of the object 18 that is momentarily opposite the arc 42. The temperature of the plasma is such that the powdered particles 44 melt at least partially before they reach the surface of the object 18. Once arrived there, they are flattened on the surface part 46, where they emit their heat to the object 16 and solidify immediately. This way they bond with the material onto which they impinge. Thus at first a thin layer (also called "lamella" not shown) is formed and, by repeating the formation of layers, a layer 50 (FIG. 3) of the sprayed material is formed on the surface of the object 18. The thickness of the lamella, among other things, depends on the speed of the powder supply, its quantity and the linear speed of the pistol 24 in axial direction of the object 18. If each layer is formed the same way, the thickness of the layer 50 depends on the number of repetitions of the layer formation. Further details of the spraying technique can be taken from the paper by Plasma Technik AG or from the general literature.

Figure 3:
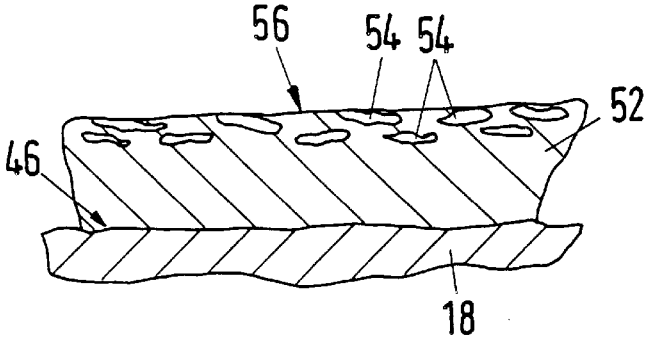
FIG. 3 shows schematically a cross section of an object which is coated in accordance with this invention.

It is an object of this invention by means of a controlled supply of more than one spraying material to influence the properties of the layer 50. FIG. 3 schematically shows an example of the structures which are realized through this invention. The largest portion of the layer thickness in this case is formed from a substratum material 52, whereby during the formation of the single layers a second material (an active substance) is sprayed in combination and forms discrete "islands" 54, which are embedded or enclosed in the substratum 52.

In the illustrated embodiment the active substance is only added during formation of the last layers, so that at least single islands 54 appear on the exposed surface 56 of the layer 50. The system could be adjusted in such a way that practically all islands 54 appear at least partially on the surface 56, which is in particularly interesting in applications where the active substance is used to achieve a certain effect on the surface 56.

It will be clear however, that an active substance could be applied at other places of the structure, e.g. in the first layers (for instance to achieve an effect on the surface 46) or throughout the layer 50 or only in other selected layers. The following examples are to be further explained where it is assumed, that in all examples a substratum 52 of a ceramic (for instance $Al_2O_3$ and/or $TiO_2$) is formed to provide wear resistance.

1) The islands 54 are formed of platinum according to FIG. 3 only in the last layers. They produce a catalytic effect on surface 56, similar to described in U.S. Pat. No. 3,902,234. Other possible material in this category are the other metals of the platinum family, that is, ruthenium, rhodium, palladium, osmium, iridium as well as their alloys.
2) Islands 54 are formed by adhesive medium such as nickel-aluminum or nickel-chromium in the first layers (on the surface 46). These improve adhesion of the layer 50 on the object 18.
3) Islands 54 are formed by a Ni/Cr-alloy and are distributed over the entire thickness of the layer 50, thus increasing the tenacity of the layer. Other possible active substances in this category are iron, molybdenum, aluminum and alloys of said metals or CERMETS or relatively ductile oxide-ceramic.

The effect of an "active substance" can be influenced by the environment, e.g. amongst other things by the temperature and the air condition, e.g. the composition of the air, and/or the air recirculation. Therefore a machine element can be formed for installation in an assembly which assures or makes possible a suitable environment. The assembly could, for instance, contain a heating device (to maintain a minimal temperature level for example) or could comprise suction or supply means (for drawing off vapor or for supplying fresh air or gas). In any case, the machine element will generally be suitable for installation in a predetermined assembly, and it could for instance be formed as a bar, which by means of a holding fixture is immersed into a liquid (stream), in order to serve as a catalyst for a predetermined chemical reaction within the liquid. It is to be understood that the known problem of "poisoning" must be considered during selection of the active substance.

Where the catalyst has to achieve a "self-cleaning" effect, it can be used for the oxidation of deposits. For this case it is of course important also that oxygen take part in the interaction with the catalyst as well as with the material to be oxidized. Hence, it may be important that the active substance be distributed as evenly as possible over the surfaces to be protected so that not all of the "islands of active substance" will be "covered". The method of spraying, along with appropriate selections as to the particle size and evenness of the coating, enables achievement of the desired distribution.

The invention is not restricted to the application of a ceramic as a treatment material. Any sprayable material could be used as the substratum. However, the ceramic materials are most interesting for this purpose because of their resistance against wear.

A high abrasion resistance is of special significance in connection with thread guiding elements, but might be less important in other cases. For example, if the invention is applied in connection with the production of self-cleaning oven walls (as in, for example, U.S. Pat. No. 3,266,477) where the catalytic effect is important, the abrasion resistance could be very low as compared for example with the abrasion resistance suitable for a textile strand drawing roller.

In order to achieve a catalytic effect, the selection of the active substance has to be made with regard to the end use. A great number of materials are suitable to function as catalysts within an appropriate "environment", even metal oxides ($Al_2O_3$, $TiO_2$), which are also resistive against wear. The choice is therefore not limited to the precious metals.

Supplying the substratum material and the active substance at the same time can be achieved by filling the reservoir 34 (FIG. 1) with the substratum powder, filling the reservoir 36 with the active substance powder, and leading transportation gas to both reservoirs 34,36. This can lead to problems however, if the quantity of the active substance only makes up a fraction of the quantity of the substratum material. In the latter case a powder mixture with the predetermined portions of the two components can be prepared and filled into a reservoir 34 or 36. In applications where the active substance is to appear only in single layers, the gas supply to its supply reservoir can be switched off or on at the appropriate time, and another spraying powder may be provided in the other reservoir.

A coated object or product of the invention now will be explained more particularly by way of the following example. The object 18 is the godet (i.e. the thread guiding part) of a drawing roller unit used in the spinning of endless filaments from synthetic polymers. Embodiments of such units are for instance shown in EP-A-454618 and in our Swiss patent No. 925/94 dated Mar. 28, 1994 (PCT/CH94/00104). The godet itself is made of steel and its outer, cylindrical surface (over which filaments run during operation) is prepared for the application of a protective layer 50 (FIG. 3) according to the known process of the spraying technique. By means of a device according to FIG. 1 a layer 50 is built up with $Al_2O_3$ as substratum with a total thickness of for instance 150 $\mu$m. Within the last layers, which altogether make up a layer thickness of approximately 10 to 20 $\mu$m, approximately 10% by weight of platinum is added to the substratum substance, so that the platinum appears on the surface 56 (FIG. 3). The godet is thus self-cleaning according to the principle as is being explained in U.S. Pat. No. 3,902,234.

The bond of the active substance (platinum) with the ceramic is so strong that the coated godet can be ground afterwards in order to obtain a predetermined surface quality, without having to accept the disadvantage of a considerable loss of platinum.

What is claimed is:

1. A thread guiding part used in textile machines for guiding threads, said thread guiding part comprising a base material with a layer of substratum material deposited thereon at least in areas of said thread guiding part contacting threads, said substratum layer further comprising discrete deposits of an active catalyst substance disposed in an upper surface of said substratum material with exposed catalyst surfaces wherein said layer of substratum material defines an exposed upper surface comprising exposed areas of said substratum material and exposed areas of said active catalyst substance, and said active catalyst substance at least partially melted into said substratum material so that said deposits of active catalyst substance are completely encased in said substratum material except for said exposed areas of catalyst substance and have a generally flat profile therein so that said upper surface of said substratum material is generally smooth for guiding threads thereon.

2. The thread guiding part as in claim 1, wherein said layer of substratum material comprises a plurality of individually deposited layers formed on top of each other, said active catalyst substance partially melted into at least a top one of said individually deposited substratum material layers.

3. The thread guiding part as in claim 1, wherein said substratum material comprises a ceramic material.

4. The thread guiding part as in claim 1, wherein said layer of substratum material and active catalyst substance comprise a total weight, said active catalyst substance comprising about up to 10% of said total weight.

5. The thread guiding part as in claim 1, wherein said layer of substratum material and active catalyst substance comprise a total weight, said active catalyst substance comprising about up to 50% of said total weight.

6. The thread guiding part as in claim 1, wherein said layer of substratum material has a layer thickness of about 150 $\mu$m, and wherein said active catalyst material is deposited in an outer portion of about 10 $\mu$m to 20 $\mu$m thereof.

7. The thread guiding part as in claim 1, wherein said thread guiding part defines a godet for a synthetic filament drawing roller unit.

* * * * *